US008220215B2

(12) United States Patent
Ismay et al.

(10) Patent No.: US 8,220,215 B2
(45) Date of Patent: Jul. 17, 2012

(54) WAVE RIPPLE WALL

(75) Inventors: Allan R. Ismay, Sylvania Heights (AU); Richard C. Perrior, Oatley (AU)

(73) Assignee: 3form, Inc., Salt Lake City, UT (US)

( * ) Notice: Subject to any disclaimer, the term of this patent is extended or adjusted under 35 U.S.C. 154(b) by 0 days.

(21) Appl. No.: 12/846,601

(22) Filed: Jul. 29, 2010

(65) Prior Publication Data

US 2011/0023398 A1 Feb. 3, 2011

Related U.S. Application Data

(60) Provisional application No. 61/230,094, filed on Jul. 30, 2009.

(51) Int. Cl.
*E04F 13/00* (2006.01)
*E04F 15/00* (2006.01)
*E04F 19/00* (2006.01)

(52) U.S. Cl. ..... 52/311.2; 52/311.1; 52/38; 52/521

(58) Field of Classification Search ..... 52/38, 531, 52/521, 535, 536, 539, 546, 555, 236.4, 235, 52/238.1, 384, 489.1, 592.1, 436, 592.4, 52/584.1, 127.1, 204.5, 220.7, 311.1, 311.2, 52/483.1, 780, 781, 506.06, 506.07
See application file for complete search history.

(56) References Cited

U.S. PATENT DOCUMENTS 3,386,220 A * 6/1968 Staats ..... 52/777
3,388,515 A 6/1968 Gruettner
3,513,608 A * 5/1970 Nagrod ..... 52/82
4,083,153 A * 4/1978 Sumpter ..... 52/28
4,121,396 A 10/1978 Oogami et al.
4,571,897 A * 2/1986 Kerr ..... 52/13
4,694,543 A * 9/1987 Conley ..... 24/461
4,696,136 A * 9/1987 Grewe ..... 52/222
4,723,386 A 2/1988 Sandow
4,769,877 A * 9/1988 Conley ..... 24/462
5,214,891 A * 6/1993 Edlin ..... 52/222
5,276,598 A * 1/1994 Hedenstrom et al. ..... 362/238
5,537,792 A 7/1996 Moliere
5,584,566 A * 12/1996 Bowman et al. ..... 362/220
5,623,800 A * 4/1997 Shinkosky ..... 52/468
5,803,560 A * 9/1998 Trulaske et al. ..... 312/223.5
5,809,709 A * 9/1998 Ryan et al. ..... 52/222
5,809,729 A * 9/1998 Mitchell ..... 52/474
6,209,271 B1 * 4/2001 Kovacs ..... 52/200
6,694,694 B2 * 2/2004 Zeeff ..... 52/506.01
7,131,747 B1 * 11/2006 Yates ..... 362/219
7,784,229 B2 * 8/2010 Ismay ..... 52/222
2002/0059777 A1 * 5/2002 Saebi ..... 52/745.07
2006/0016145 A1 * 1/2006 Lonneman ..... 52/506.06
(Continued)

FOREIGN PATENT DOCUMENTS

AU 23436/70 6/1972
(Continued)

*Primary Examiner* — Mark Wendell
(74) *Attorney, Agent, or Firm* — Workman Nydegger

(57) ABSTRACT

Systems, apparatuses, and methods configured for installing a decorative feature having a wave-like appearance. For example, a system for installing the decorative feature can include one or more mounts configured to attach to a support structure and support one or more decorative panels. The system can also include a plurality of decorative panels configured to be disposed within or supported by the mounts. Each decorative panel can have a concave or convex configuration to produce a wave-like appearance.

20 Claims, 12 Drawing Sheets

U.S. PATENT DOCUMENTS

2007/0017171 A1* 1/2007 Ismay ..... 52/236.4

FOREIGN PATENT DOCUMENTS

| | | |
|---|---|---|
| DE | 201 08 950 | 9/2001 |
| EP | 0 414 519 | 2/1991 |
| NL | 8 702 073 | 4/1989 |
| WO | 98/18900 | 7/1995 |
| WO | 98/09038 | 3/1998 |

* cited by examiner

WAVE RIPPLE WALL

BACKGROUND OF THE INVENTION

1. The Field of the Invention

The present invention relates to systems, methods, and apparatus for decorative treatments having a wave-like appearance.

2. The Relevant Technology

Recent trends in building design involve adding to the functional and/or aesthetic characteristics of a given structure or design space by mounting one or more decorative panels thereto. This is partly because there is sometimes more flexibility with how the given panel (or set of panels) is designed, compared with the original structure. For example, panels can be made with various shapes and geometric configurations that add depth, colors, and other aesthetic features that a designer may desire to create a particular look and feel in a design space.

Decorative panels are particularly useful to a designer that may want to add three-dimensional depth to a structure, such as a wall or ceiling. In particular, a designer may use decorative panels to create three-dimensional features within the panel such that the decorative panel's display surface is not planar. These three-dimensional features create a unique aesthetic that may be impossible or cost prohibitive for a designer to create in the structure itself, such as a wall or ceiling.

Unfortunately, conventional three-dimensional decorative panels, and the respective mounting systems and hardware used to mount three-dimensional panels to a structure, tend to suffer from a number of drawbacks, limitations, and complications. This is particularly true when attempting to mount decorative panels that do not have a flat configuration to a substantially flat structure such as a wall or ceiling.

For example, conventional systems that mount decorative panels with curved surfaces may be difficult to install and labor intensive. In particular, conventional systems may include a large number of parts and pieces that an assembler first assembles before mounting the system to a support structure. Moreover, conventional systems may include additional numbers of parts and pieces that an assembler must continue to assemble in order to attach the curved decorative panels to the mounting system. Due to the large number of parts, the installation of conventional systems may become complex and require an inefficient amount of labor to install.

In addition to installation issues, conventional mounting system hardware is often unsightly, too noticeable, or does not provide an appropriate aesthetic for a desired design environment. In particular, conventional mounting systems may include bulky hardware that distracts from the aesthetic of the decorative panels. Moreover, the manner in which conventional mounting systems attach to a support structure may be very visible, thus reducing the aesthetic affect the designer desires to achieve. Conventional mounting systems may include various other aesthetic issues, including visible screws, fasteners, and other parts that may cause many conventional mounting systems to appear more mechanical, rather than decorative.

Additionally, because conventional mounting systems often include a large number of parts, the cost to design, manufacture, package and ship increases. Due to the increase in the cost to manufacture, package and ship many conventional mounting systems, the cost to use decorative panels on a project also increases. This is especially the case on larger projects where a designer wants to use several decorative panels to decorate a design space.

Accordingly, there are a number of disadvantages in conventional mounting systems for decorative panels that can be addressed.

BRIEF SUMMARY OF THE INVENTION

Implementations of the present invention solve one or more of the problems in the art with systems, methods, and apparatus for mounting curved decorative panels as partitions, displays, barriers, treatments, or other structures with increased functional versatility. For example, one or more implementations of the present invention include a decorative panel mounting system that an assembler can easily and quickly install to a support structure resulting in a decorative treatment having a wave-like appearance. In addition, the decorative panels of the mounting system can be easily packaged and shipped in a flat configuration, and then later bent upon installation to produce the wave-like effect of the resulting decorative treatment.

For example, on implementations includes a system for installing a decorative feature having a wave-like appearance. The system includes a first internal mount and second internal mount coupled to a support structure with a distance between the first internal mount and the second internal mount. The system further can include a first external mount connected to the first internal mount and a second external mount connected to the second internal mount. Moreover, the first external mount and the second external mount both include at least one groove. The system can further include at least one decorative panel having a first edge that interfaces with the groove in the first external mount and a second edge that interfaces with the groove in the second external mount. In this way, the decorative panel is secured between the first external mount and the second external mount with a convex or concave deflection to create the wave-like appearance.

Another example implementation includes a decorative panel mounting assembly having decorative panels that form a wave-like aesthetic. For example, the decorative panel mounting assembly can include a plurality of external mounts coupled to a support surface in parallel rows. The assembly can further include a plurality of decorative panels secured between the plurality of external mounts to form rows of decorative panels. The rows of decorative panels can alternate between the decorative panels having a convex configuration and having a concave configuration to form a wave-like appearance.

Example implementations of can further include a method of installing a decorative feature with a wave-like appearance to a support structure. The method can include the act of attaching a plurality of mounts to a support structure in a parallel row configuration. Also, the method can further include the act of deflecting one or more flat decorative panels to form a curved decorative panel. Moreover, the method can include the act of securing one or more curved decorative panels between the mounts in a concave configuration. Additionally, the method can include the act of securing one or more curved decorative panels between the mounts in a convex configuration.

Additional features and advantages of exemplary implementations of the present invention will be set forth in the description which follows, and in part will be obvious from the description, or may be learned by the practice of such exemplary implementations. The features and advantages of such implementations may be realized and obtained by means of the instruments and combinations particularly pointed out in the appended claims. These and other features will become more fully apparent from the following description and appended claims, or may be learned by the practice of such exemplary implementations as set forth hereinafter.

BRIEF DESCRIPTION OF THE DRAWINGS

In order to describe the manner in which the above-recited and other advantages and features of the invention can be obtained, a more particular description of the invention briefly described above will be rendered by reference to specific embodiments thereof which are illustrated in the appended drawings. Understanding that these drawings depict only typical embodiments of the invention and are not therefore to be considered to be limiting of its scope, the invention will be described and explained with additional specificity and detail through the use of the accompanying drawings in which.

DETAILED DESCRIPTION OF THE PREFERRED EMBODIMENTS

Implementations of the present invention solve one or more of the problems in the art with systems, methods, and apparatus for mounting curved decorative panels as partitions, displays, barriers, treatments, or other structures with increased functional versatility. For example, one or more implementations of the present invention include a decorative panel mounting system that an assembler can easily and quickly install to a support structure resulting in a decorative treatment having a wave-like appearance. In addition, the decorative panels of the mounting system can be easily packaged and shipped in a flat configuration, and then later bent upon installation to produce the wave-like effect of the resulting decorative treatment.

In particular, implementations of the present invention provide decorative panel mounting systems that include a minimal number of parts and pieces to create a simple and easy mounting system for an assembler to install. For example, implementations of the present invention provide decorative panel mounting systems that include fewer parts and pieces compared to conventional mounting systems. Thus, assembly of the decorative panel mounting system is easier and less labor intensive, allowing an assembler to efficiently install the decorative panel mounting systems in a cost effective manner.

Additionally, implementations of the present invention provide decorative panel mounting systems with hardware that is sleek, small, and/or substantially invisible. The sleek, small, and/or substantially invisible hardware provides a decorative panel mounting system that does not detract from the overall aesthetic of the decorative panels. Moreover, implementations of the decorative panel mounting system includes sleek, small, and/or substantially invisible hardware does not show fasteners, screws, or other mechanical hardware. Therefore, implementations of the decorative panel mounting system provide a system that does not appear mechanical and allows the viewer to focus on the artistic aesthetic of the decorative panels.

In addition, implementations of the present invention provide a cost effective method of manufacturing, packaging, and shipping the decorative panel mounting system and decorative panels. For example, the mounting system is made from a minimal number of parts or pieces that reduces the number of parts that need to be manufactured, packaged, and shipped. Moreover, the curved panels can be manufactured and shipped in a flat configuration, reducing the size of packaging and ultimately reducing the cost of shipping the decorative panels compared to conventional mounting systems and curved decorative panel systems.

Figure 1A:
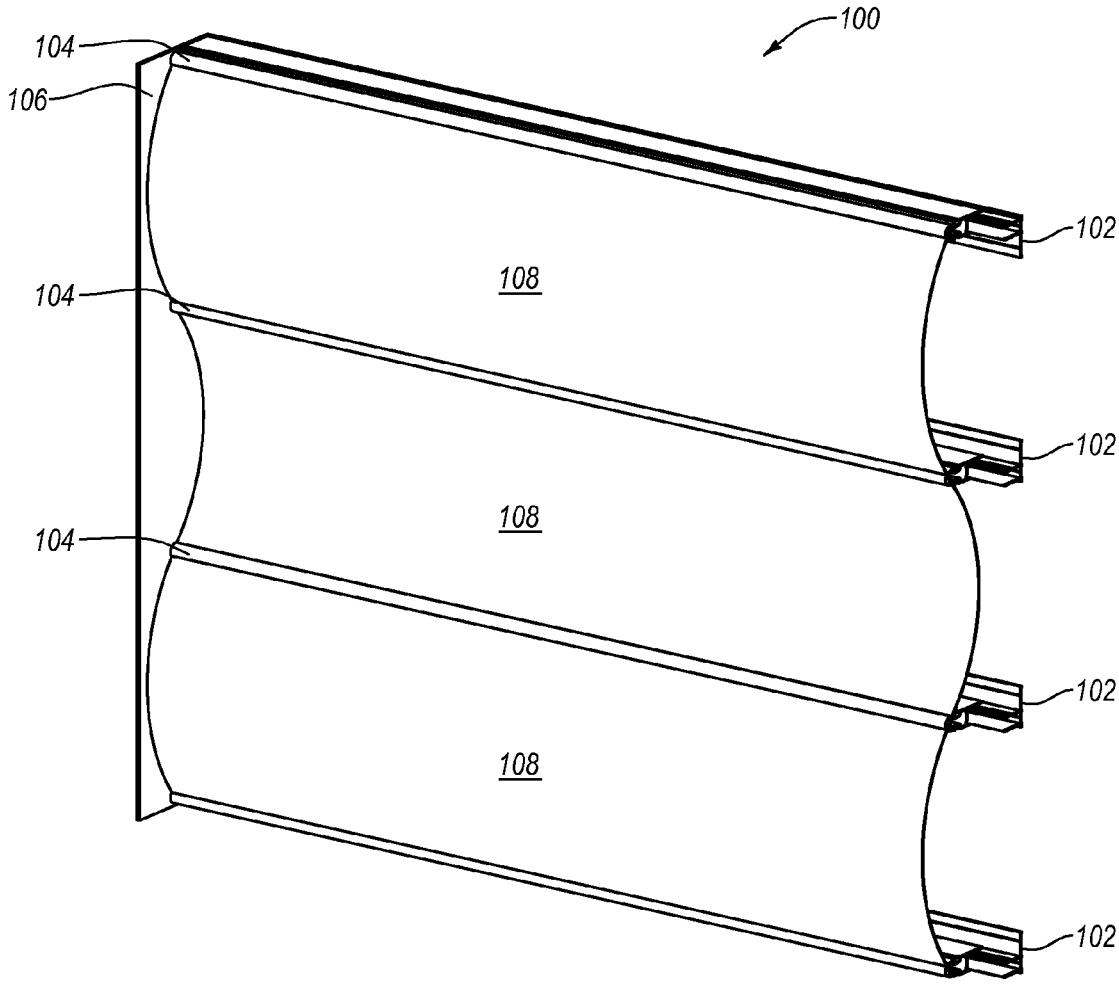
FIG. 1A illustrates a perspective view of an example mounting system in use with example decorative panels.

The above advantages and other features and characteristics of the present invention will be described in further detail with reference to FIGS. 1A through 6C. FIG. 1A illustrates an example decorative panel mounting system 100 in accordance with one or more implementations of the present invention that is used to mount curved decorative panels 108. In general, the decorative panel mounting system 100 can include an internal wall mount 102 that connects to external panel mounts 104. A plurality of curved decorative panels 108 are held in place between the external panel mounts 104. In at least one implementation, an edge trim 106 couples to the edge of the decorative panel mounting system 100 to provide a clean sleek edge.

As used herein, the term "decorative panel" shall mean any decorative panel or panel or similarly shaped decorative member of any size or finish. Moreover, a decorative panel 108 refers to any panel/tile made from any number of differently planar and flexible materials. In one or more implementations, each decorative panel can comprise one or more layers or sheets formed from one or more resin-based materials (or alloys thereof). Specifically, such materials include but are not limited to, polyethylene terephthalate (PET), polyethylene terephthalate with glycol-modification (PETG), acrylonitrile butadiene-styrene (ABS), polyvinyl chloride (PVC), polyvinyl butyral (PVB), ethylene vinyl acetate (EVA), polycarbonate (PC), styrene, polymethyl methacrylate (PMMA), polyolefins (low and high density polyethylene, polypropylene), thermoplastic polyurethane (TPU), cellulose-based polymers (cellulose acetate, cellulose butyrate or cellulose propionate), timber veneers, timber laminates, laminates, metal laminates, aluminum, texpanels, leather, or the like.

In addition to the various materials used to make the decorative panels 108, the decorative panels 108 can include a range of customized finishes. In one configuration, each decorative panel 108 in the decorative panel mounting system 100 can have the same or similar aesthetic finish. In further configurations, the aesthetic finishes of the decorative panels 108 can vary from one decorative panel 108 to another. Moreover, the decorative panels 108 can also provide flexibility in terms of color, degree of texture, gauge, and impact resistance. Furthermore, the panels can be formed to include a large variety of artistic colors, images, patterns, and shapes.

Notwithstanding the material or finish of the decorative panels 108, the size of the decorative panel 108 can vary from one implementation to the next and within the same implementation. Decorative panels 108 can be virtually any size and have a wide range of lengths and widths that can be used to produce various wave-like effects. For example FIG. 1A illustrates an example of decorative panels 108 that have a length greater than a width providing a long slender wave-like effect. In alternative implementations, the decorative panels 108 can have a width greater than the length, or a width that is substantially equal to the length to provide various wave-like aesthetics.

Accordingly, the general dimensions of each of the decorative panels 108 can vary from one implementation to next. For example, the length of an example decorative panel can range between about 6 inches and about 12 feet. In a further implementation, the length of the decorative panel 108 can range between about 2 feet and about 9 feet. In a yet further implementations, the length of the decorative panel 108 between about 3 feet and about 5 feet. Similarly, the width of any of the decorative panels 108 can range between about 2 inches and about 36 inches. In a further implementation the width of the decorative panels 108 can range between about 6 inches and about 24 inches. In a yet further implementation, the width of the decorative panels 108 can range between about 9 inches and about 15 inches. Custom-sized dimensions are also possible for any desired result.

In addition to varying the size of the decorative panels 108, the number of decorative panels 108 used in the decorative panel mounting system 100 can vary. FIG. 1A, for example, shows a decorative panel mounting system 100 that includes three decorative panels 108. In alternative implementations, an assembler can use the decorative panel mounting system 100 to mount fewer decorative panels 108 or more decorative panels. For example, the decorative panel mounting system 100 can allow an assembler to mount a single decorative panel, or alternatively, the decorative panel mounting system 100 can allow an assembler to create a large decorative feature that supports hundreds of decorative panels 108 that cover a large design area.

Notwithstanding the large variety and variations in the decorative panels 108, the decorative panel mounting system 100 allows an assembler to easily install the decorative panels 108 into the decorative panel mounting system 100. For example, FIG. 1A illustrates that an assembler can bend or deflect each decorative panel 108 into a concave or convex configuration to produce a wave-like configuration (see also FIG. 3 for example). In addition, the decorative panel mounting system 100 allows an assembler to easily swap the decorative panels 108 with decorative panels 108 of different materials or aesthetics at a later date to easily and efficiently change the look of a design space.

Due to the fact that an assembler deflects or bends the panels 108 to install the decorative panels 108 into the decorative panel mounting system 100, a manufacturer can package and ship the decorative panels 108 in a flat package. Upon unpacking the flat decorative panels 108, an assembler can deflect the decorative panels 108 as desired to create the wave-like appearance of the decorative feature.

The decorative panel mounting system 100 can provide the assembler the flexibility of creating a decorative feature on a wall, ceiling, floor, or any other support structure of any shape or size. For example, FIG. 1A shows that an assembler can use the decorative panel mounting system 100 on a wall structure. However, an assembler can just as easily use the decorative panel mounting system 100 to provide the same or similar feature in FIG. 1A on a ceiling, floor, or other support structure.

Figure 1B:
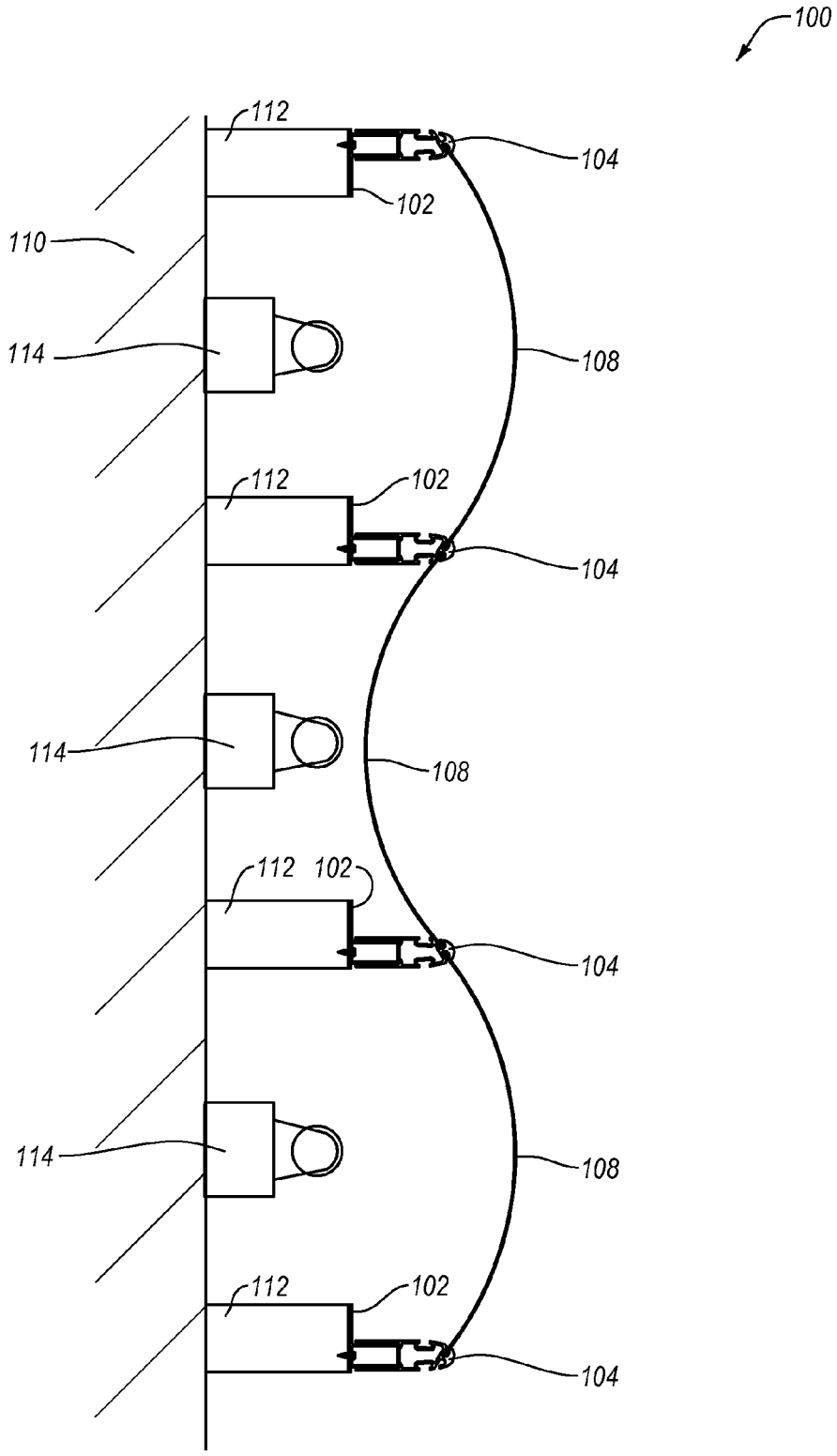
FIG. 1B illustrates a side view of the example mounting system illustrated in FIG. 1A.

The way in which the decorative panel mounting system 100 interfaces with a support structure can vary from one implementation to the next. FIG. 1B illustrates a side view of the example decorative panel mounting system 100 interfacing with a support structure 110. In particular, FIG. 1B illustrates that the internal mount 102 couples to a plurality of battens 112. For example, an assembler can fix the plurality of battens 112 to the support structure 110 at the positions where the assembler desires to install corresponding internal mounts 102. An assembler can use any number of fasteners, adhesives, or other fastening mechanisms to fix the battens 112 to the support structure 110. The assembler can then fix the internal mounts 102 to the corresponding battens 112 one or more fastening mechanism.

In addition to providing a connection point between the internal mount 102 and the support structure 110, an assembler can use the battens 112 to vary the offset of the decorative panels 108 from the support structure 110. As used herein, the term "standoff distance" shall mean the distance between the decorative panels 108 and the support structure 110, such as the wall, ceiling, or other support structure to which the decorative panel mounting system 100 is connected.

As FIG. 1B illustrates, the standoff distance of the panels can also vary depending on whether the panel is a convex or concave panel. The standoff distance in one implementation can be within the range of about 0 inches to 24 inches, in a further implementation within the range of about ⅛ inch to about 12 inches, and in a yet further implementation within the range of about ¼ inch to about 6 inches. Moreover, the standoff distance can vary within a single implementation of the decorative panel mounting system 100.

In an alternative configuration, an assembler does not use the battens 112 and instead can mount the internal mount 102 directly to the support structure 110, such as a wall or ceiling. For example, an assembler can couple the internal mount 102 to the support structure 110 using any number of available fasteners, adhesives, or other similar mechanisms (see FIG. 5C for example).

The length of the internal mounts 102 can vary from one application to next. In one implementation, for example, the internal mount 102 can extend along the entire length of the decorative panel mounting system 100. In a further implementation, a plurality of internal mounts 102 can be positioned end to end to substantially span the length of the decorative panel mounting system 100. In a yet further configuration, an assembler can cut the internal mounts 102 to the length desired for a particular application.

Once the internal mount 102 is coupled to a structure, the assembler can couple the external mount 104 to the internal mount 102. The length of the external mounts 104 can also vary as desired for a particular application. For example, FIG. 1A illustrates that the external mounts 104 can have a length substantially equal to the lengths of the corresponding decorative panels 108 of the mounting system. In an alternative implementation, the external mounts 104 can vary. Moreover, an assembler can cut the external mounts 104 to the length desired for a particular application.

In one configuration, the external mounts 104 are at least partially visible to a viewer of the decorative panel mounting system 100. For example, FIG. 1A illustrates that the edge of the external mounts 104 are visible. Accordingly, a manufacture can anodize or powder-coat the external mounts 104 to provide a particular finish or aesthetic.

Regardless of the visual characteristics of the external mount 104, after an assembler couples the external mounts 104 to the internal mounts 102, the assembler can use the external mounts 104 to receive and hold one or more decorative panels 108. For example, FIG. 1B illustrates that the external mounts 104 can include one or more grooves or slots along the length thereof that receive and/or hold an edge of the decorative panels 108. In particular, an assembler can space the external mounts 104 to allow an assembler bend or deflect the decorative panels 108 while positioning the decorative panel 108 in a groove or slot on the external mounts 104. The elastic properties of the decorative panels 108 provide the necessary tension to hold the decorative panels 108 in position within the grooves of the external mounts 104.

In addition to the decorative panels 108, the decorative panel mounting system can include various other features that affect the aesthetic of the decorative feature. For example, FIG. 1B further illustrates an implementation of the decorative panel mounting system 100 that can include light sources 114. As shown in FIG. 1B, the decorative panel mounting system 100 can include one or more light sources 114 that an assembler can position between the decorative panels 108 and the support structure 110. For example, the decorative panel mounting system 100 can include one or more fluorescent lights that attach to the support structure 100.

The light source 114 can provide a light that is visible to a viewer of the decorative panel mounting system 100 and enhances the aesthetic attributes of the decorative panel mounting system 100. In particular, light from the light source 114 can pass through gaps between decorative panels 108 to create a unique light aesthetic. Moreover, light from the light source 114 can pass through decorative panels 108 that are at least partially translucent to provide additional light aesthetic.

As FIGS. 1A and 1B illustrate together, once an assembler assembles the decorative panel support structure 100, the support structure 110, the internal mount 102, and a majority of the external mount are hidden from view by the decorative panels 108, creating a sleek and clean aesthetic. Moreover, any additional hardware, such as battens 112 or light sources 114 are also hidden from view by the decorative panels 108. In this way, the decorative panel mounting system 100 provides an efficient and easy way for a designer and assembler to decorate a design space.

Figure 1C:
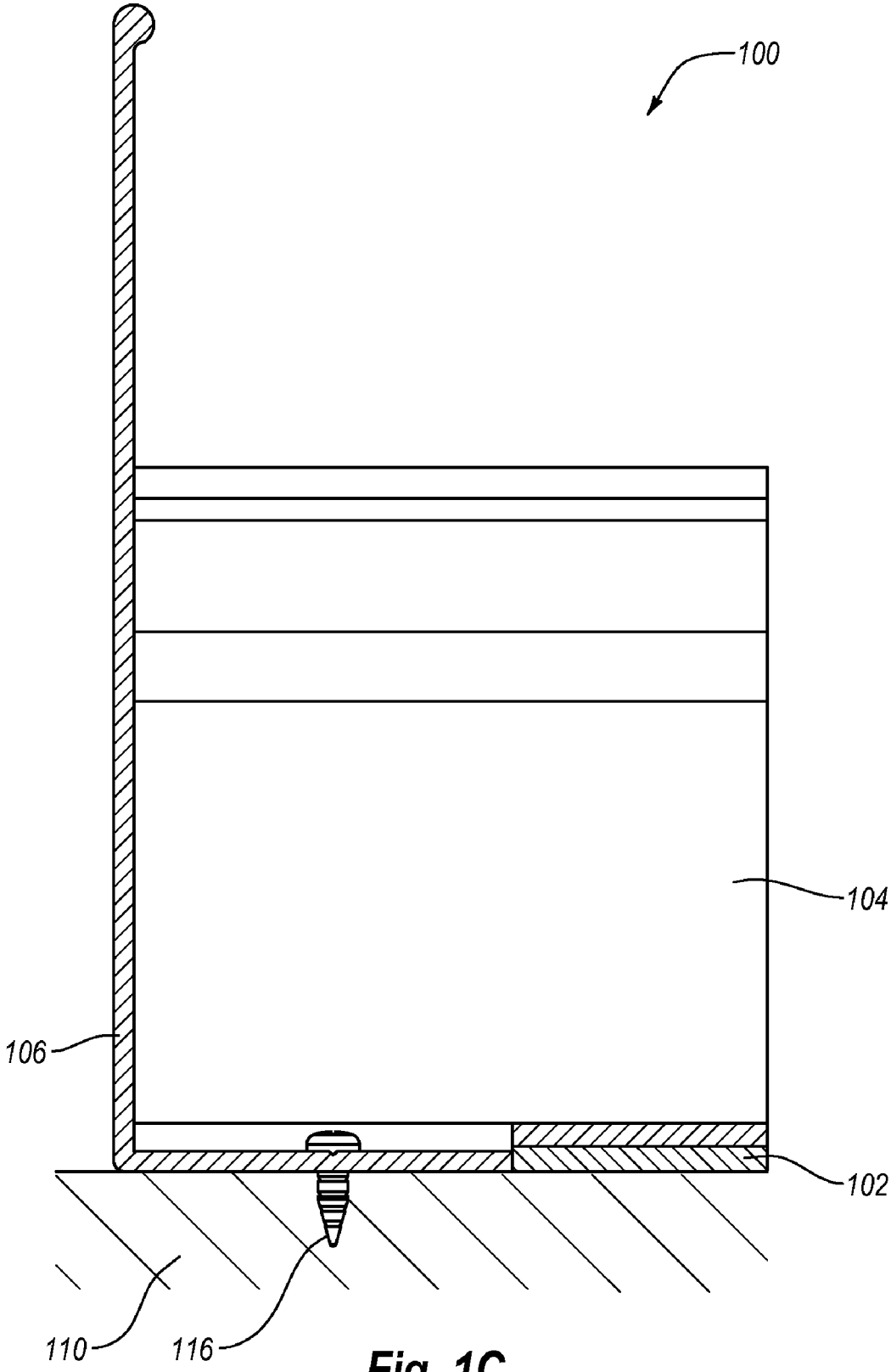
FIG. 1C illustrates an example edge trim for use with the mounting system illustrated in FIG. 1A.

In addition to the various configurations and characteristics described above, the decorative panel mounting system 100 can also include the edge trim 106, as discussed briefly with reference to FIG. 1A. FIG. 1C illustrates a top view of the decorative mounting system 100 illustrating one example of how the edge trim 106 interfaces with the external mount 104 as well as the support structure 110. For example, FIG. 1C illustrates that an assembler can attach the edge trim 106 to the support structure 110 using a fastener 116. In particular, the fastener 116 can be a screw or nail type fastener. In alternative implementations, an assembler can attach the edge trim 106 to the support structure 110 using a variety of different types of fasters, including adhesives, clips, and/or other similar fasteners that can securely fasten the edge trim 106 to the support structure.

Because the edge trim 106 can fasten directly to the support structure 110, the external mount 104 is able to overlap the portion of the edge trim 106 that attaches to the support structure 110. For example, FIG. 1C illustrates that the edge trim 106 can be flush or substantially adjacent to the interior mount 102 and that the external mount 104 over hangs the internal mount 102 by a distance that allows the external mount 104 to completely cover the portion of the edge trim 106 that attaches to the support structure 110. In an alternative implementation, the edge trim 106 can include a configuration that allows an assembler to attach the edge trim 106 directly to the exterior mount 104 and/or to the interior mount 102. As is shown in FIGS. 1A and 1C, the edge trim 106 can provide a more finished look to the edge of the decorative panel mounting system 100 and can cover the gap between the support surface 110 and the decorative panels 108.

Figure 2:
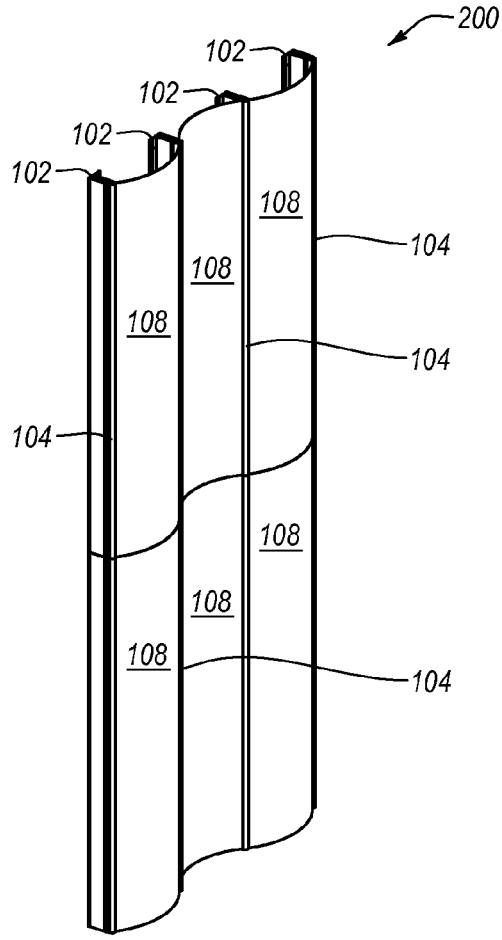
FIG. 2 illustrates an example mounting system having a continuous wave configuration with a vertical orientation.

An assembler can use the above features and characteristics of the decorative panel mounting system 100 to provide decorative features with various characteristics. For example, FIG. 2 illustrates a vertical decorative feature 200. As FIG. 2 shows, the vertical decorative feature 200 includes the same parts as the decorative panel mounting system 100 shown in FIG. 1A. Thus, FIG. 2 illustrates that an assembler can use the exact same parts to create various decorative features with various orientations. For example, additional example implementations of the decorative panel mounting system 100 can be used to create decorative panel features that are at an angle with respect to the support structure 110.

With respect to the vertical orientation that FIG. 2 shows, an assembler can use the vertically-oriented decorative panels 108 to provide a decorative feature around internal or external corners on walls. An assembler can also mount vertically-oriented systems onto curved walls.

Figure 3:
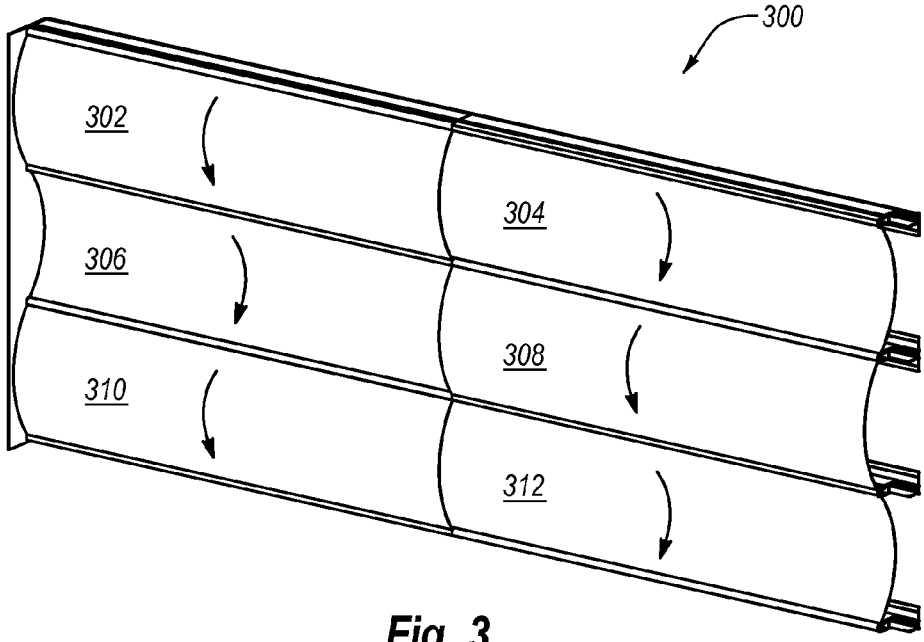
FIG. 3 illustrates an example mounting system having an alternating wave configuration.

In addition to varying the orientation of the decorative panel mounting system 100, the decorative panels 108 can form various wave-like formations. For example, FIG. 1A and FIG. 2 illustrate that the wave-like formation can be uniform across the decorative panel mounting system 100. FIG. 3, on the other hand, illustrates a decorative panel feature 300 where the wave-like formation alternates across the decorative panel feature 300.

In particular, FIG. 3 illustrates a first decorative panel 302 can have a convex configuration, while a second decorative panel 304 that is adjacent to the first decorative panel 302 has a concave configuration. On the next row of decorative panels, the pattern can reverse. For example, a third decorative panel 306 can have a concave configuration, while a fourth decorative panel 308 has a convex configuration. The pattern can then reverse again such that a fifth decorative panel 310 can have a convex configuration and a sixth decorative panel 312 can have a concave configuration. Any number of alternating patterns, or random patterns, can be created using the ability of the decorative panel mounting system 100 to alternate between concave and convex configurations of the decorative panels.

Figure 4A:
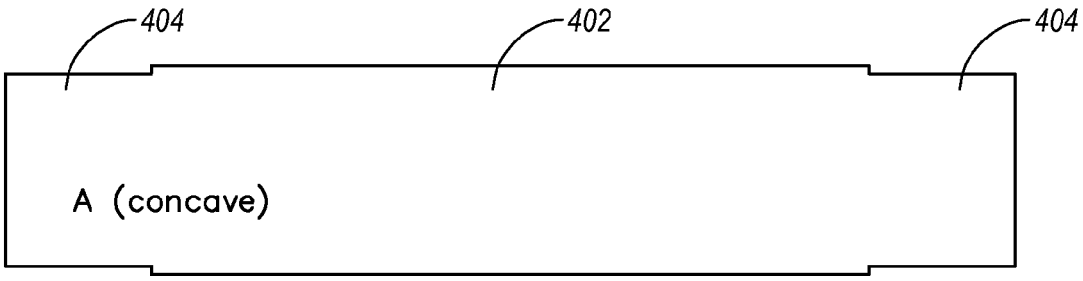
FIGS. 4A through 4C illustrate example decorative panels for use in a mounting system.
Figure 4B:
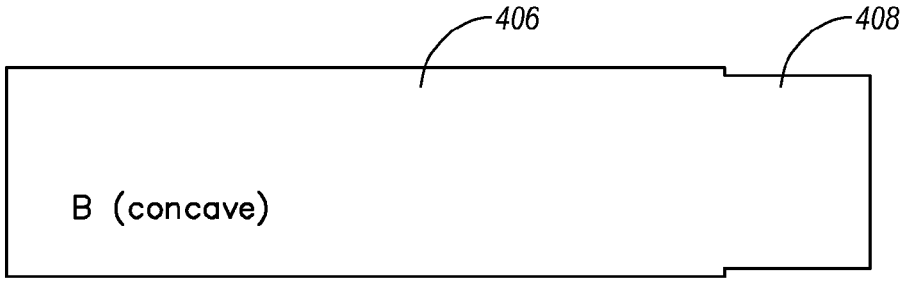
Figure 4C:
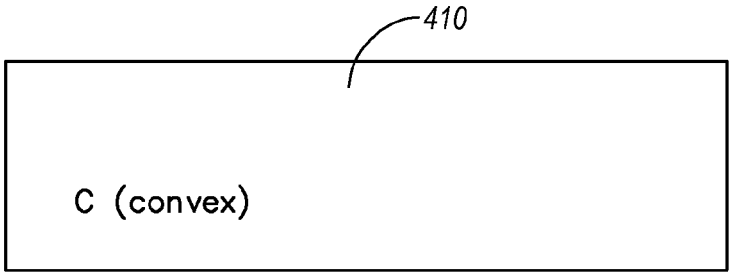

Depending on the final aesthetic look a designer desires, a designer can use various decorative panel configurations to create alternating wave-like formations. For example, FIGS. 4A through 4C illustrate example decorative panels for use in a decorative panel mounting system having an alternating wave configuration. In particular, FIG. 4A illustrates a first concave decorative panel 402 (or "A" panel) configured to be positioned between, overlapped by, and extend behind the edges of two convex panels. As shown, the first concave decorative panel 402 includes ends 404 that have a reduced dimension, such as width, to facilitate installation next to and abutment with adjacent convex decorative panels.

Similarly, FIG. 4B illustrates a second concave decorative panel 406 (or "B" panel) being configured to abut the edge trim 106 of the decorative panel mounting system 100 at one end and to be overlapped by and extend behind an adjacent convex panel at the other end. As shown, the second concave decorative panel 406 includes one end 408 with a reduced dimension, such as width, to facilitate installation next to and abutment with adjacent convex decorative panels.

FIG. 4C, on the other hand, illustrates a convex decorative panel (or "C" panel) having a rectangular shape and being configured to abut the edge of the mounting system or abut and overlap adjacent concave decorative panels (i.e., the first concave panel 402 and/or the second concave panel 404) at either end.

Figure 4D:
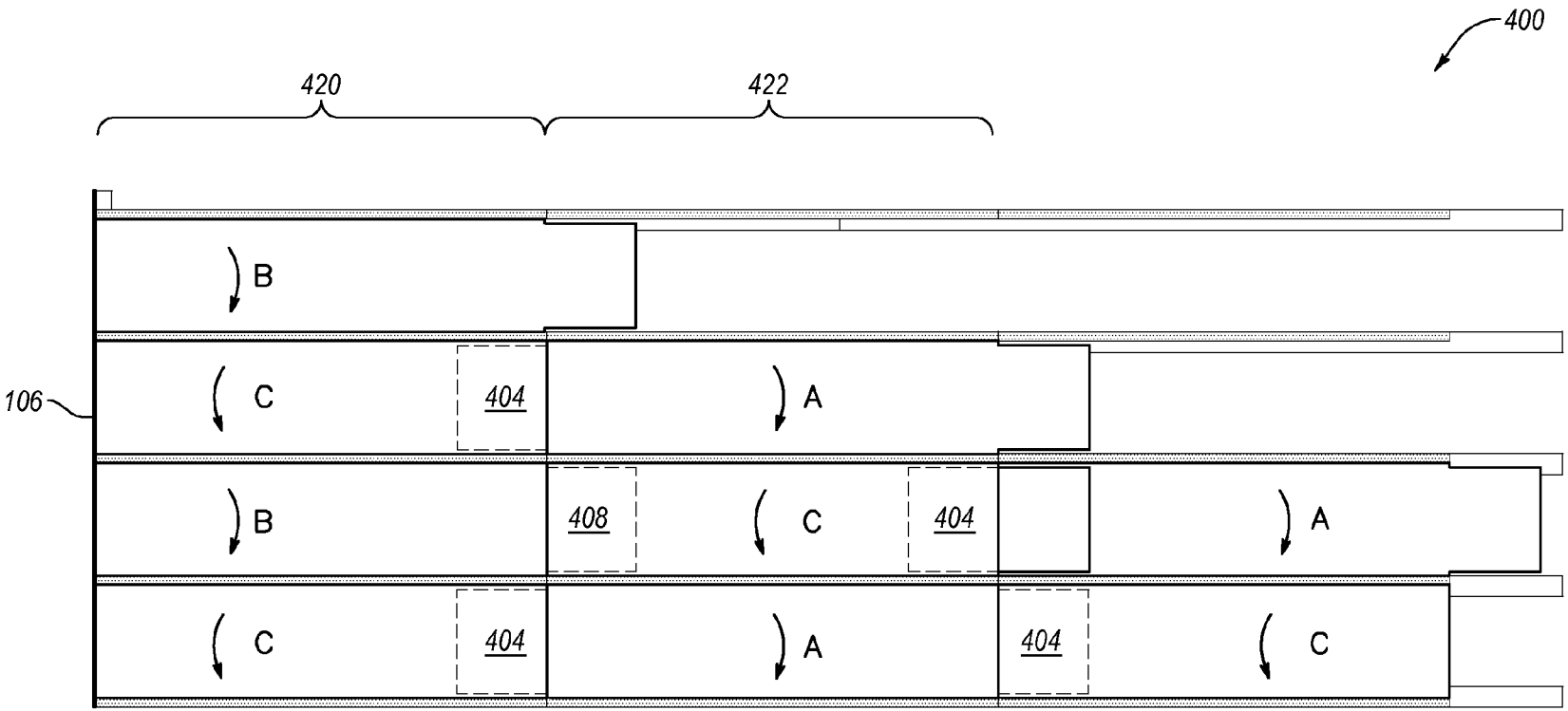
FIG. 4D illustrates a front view of an example mounting system having an alternating wave configuration using the decorative panels illustrated in FIGS. 4A through 4C.

FIG. 4D illustrates an example configuration of a decorative panel feature 400 including the decorative panels illustrated in FIGS. 4A through 4C. In particular, the decorative panel feature 400 includes a first set of decorative panels 420 comprising a plurality of concave "B" panels and a plurality of convex "C" panels positioned adjacent the edge trim 106 of the mounting system.

The decorative panel feature 400 further includes a second set of decorative panels 422 adjacent the first set of decorative panels 420 that includes a plurality of concave "A" panels positioned adjacent the convex "C" panels of the first set of decorative panels 420. FIG. 4D shows that the reduced dimension edge 404 of the concave "A" panels slides behind the convex "C" panel. The second set of decorative panels 422 further includes a convex "C" panel positioned adjacent the concave "B" panel of the first set of decorative panels 420. The reduced dimension edge 408 of the concave "B" slides behind the convex "C" panel. This pattern continues until the panels reach the edge trim located on the opposite end of the decorative panel feature 400. In a further configuration, the decorative panel feature 400 can include more or less sets of decorative panels.

Regardless of the various patterns in which an assembler can install various decorative panels, there are a variety of ways in which the assembler can assemble the external mount 104 to the internal mount 102. In one implementation, the external mount 104 couples to the internal mount 102 without the need of fasteners, adhesive, or other similar mechanisms. In particular, FIGS. 5A and 5B illustrate how an assembler can easily assemble the external mount 104 with the internal mount 102.

Figure 5A:
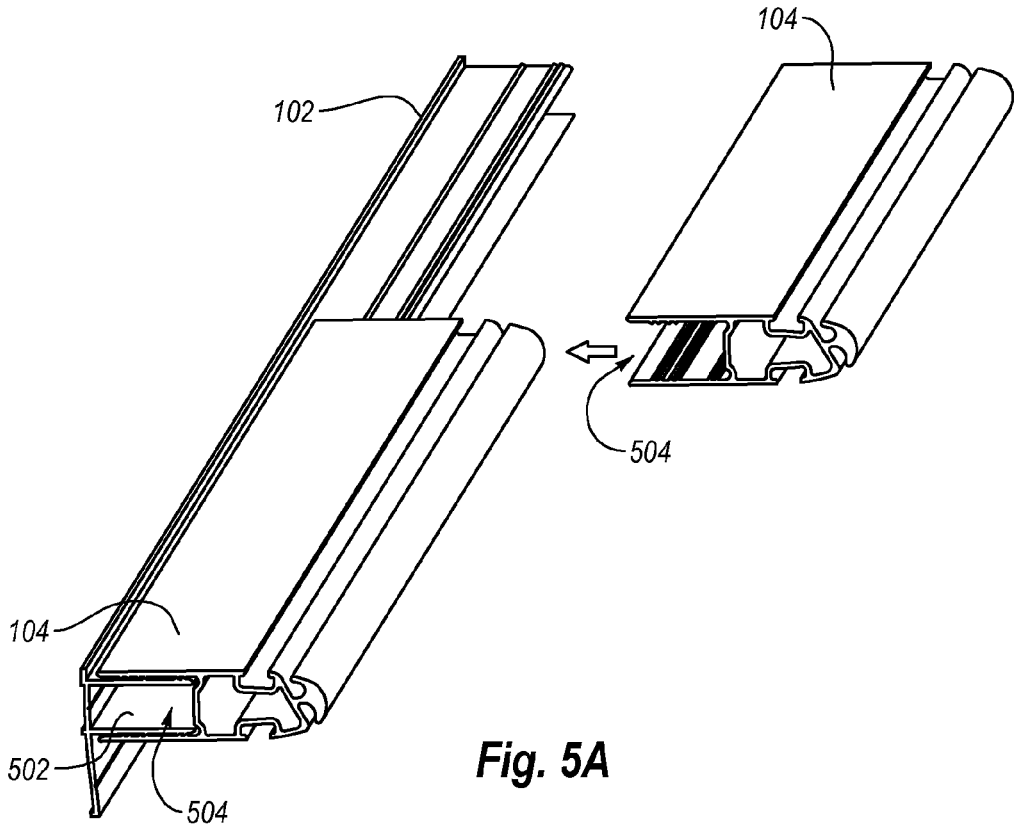
FIGS. 5A through 5B illustrate a perspective view of example mounting system hardware.

For example, FIG. 5A illustrates that the internal mount 102 can comprise a U-shaped extension 502 that extends within a receiving portion 504 of the external mount 104. The internal mount 102 can include an elongate extrusion of any of a number of materials, such as aluminum, other metals, plastics, composites, and/or the like. Similarly, the external mount 104 can comprise an elongate extrusion of any of a number of materials, such as aluminum, other metals, plastics, composites, and/or the like.

Figure 5B:
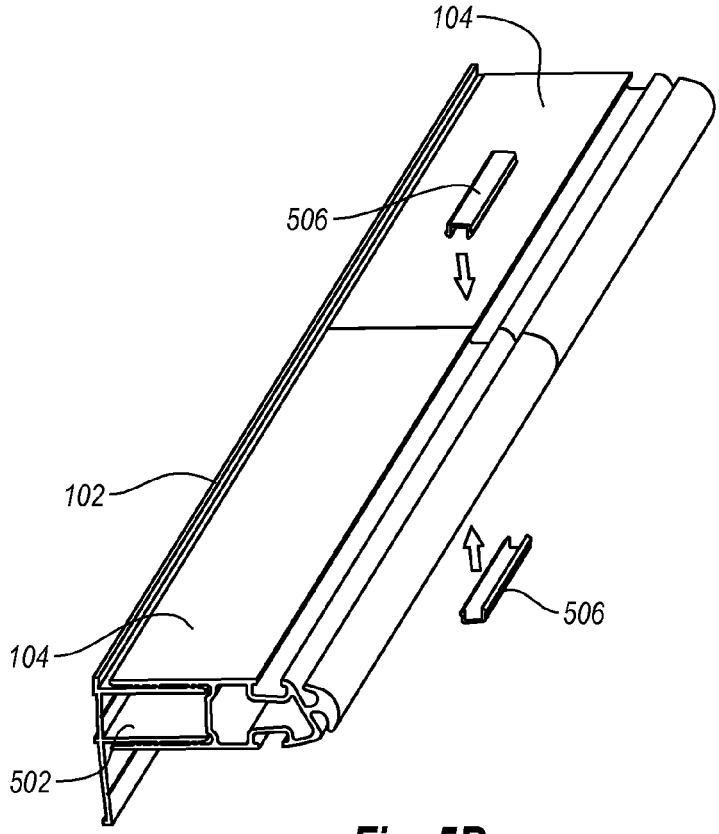

Regardless of the materials of the external mount 104 and the internal mount 102, FIGS. 5A and 5B illustrate that an assembler can snap the external mount 104 onto the internal mount 102 by placing the U-shaped extension 502 within the receiving portion 504. As FIG. 5B further shows, an assembler can slide retainer members 506 into one or more of several grooves on the external mount 104 to support and strengthen the interface between two external mounts 104.

Figure 5C:
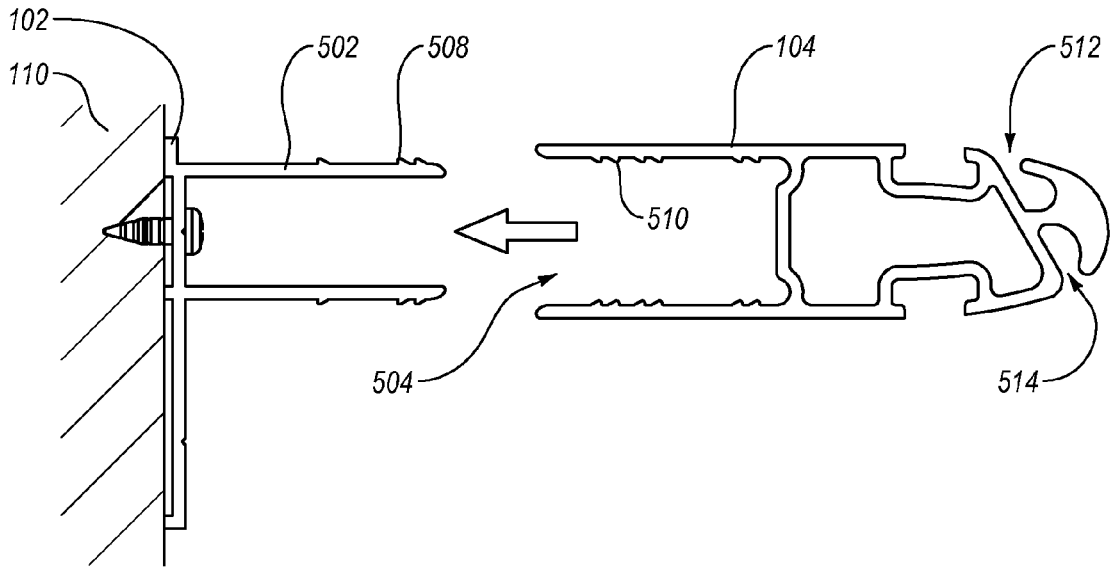
FIGS. 5C through 5D illustrate a cross-sectional view of the mounting system hardware illustrated in FIGS. 5A and 5B.
Figure 5D:
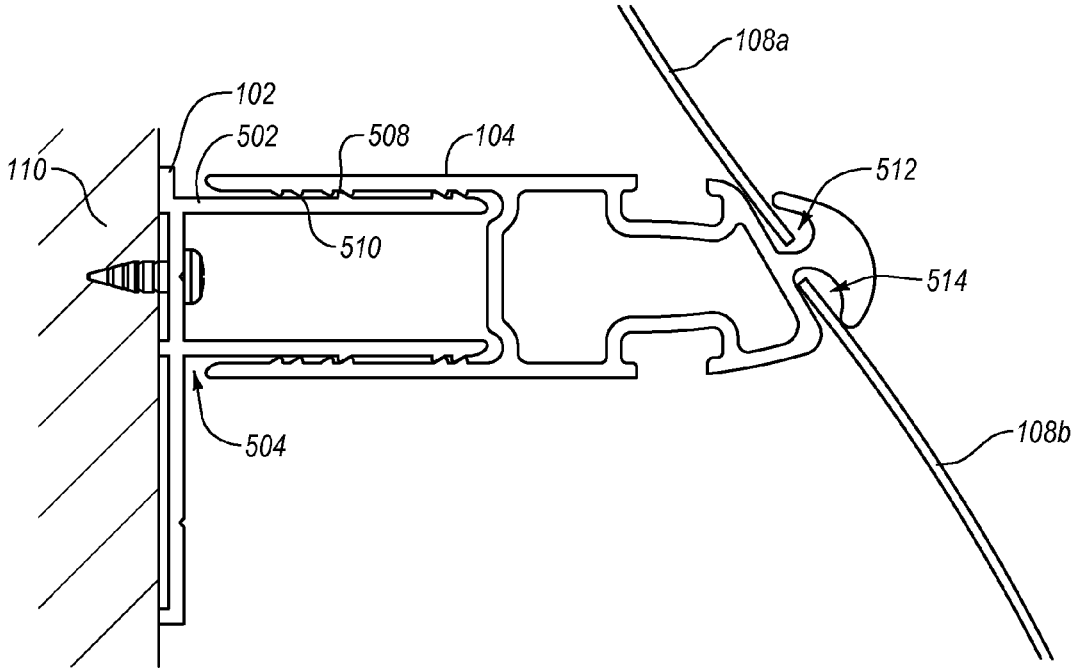

FIGS. 5C and 5D further illustrate one implementation in which the external mount 104 couples to the internal mount 102. FIG. 5C illustrates that the internal mount can include a plurality of raised protrusions 508 located on the outer edge of the U-shaped extension. The plurality of raised protrusions 508 that interface with corresponding raised protrusions 510 on the inside edge of the receiving portion 504. Thus, to assemble the external mount 104 with the internal mount 102, an assembler presses the external mount 104 onto the internal mount 102 until the raised protrusions 508 and 510 snap together to hold the external mount 104 in place on the internal mount 102.

There can be any number of raised protrusions 508 and 510 in any number of locations on the internal mount 102 and the external mount 104. For example, FIGS. 5A and 5B illustrate one implementation where the raised protrusions 508 and 510 are positioned such that the U-shaped extension 502 is almost completely inserted into the receiving portion 504 before all the raised protrusions 508 interface with the all the raised protrusions 510. In alternative implementations, the raised protrusions 508 and 510 can be in various other locations and configured to interface along various depths of insertion. Therefore, the external mount 104 can be coupled to the internal mount 102 at various depths of insertion of the U-shaped extension 502 within the receiving portion 504.

In addition to the raised protrusions 510, FIG. 5D further illustrates that the external mount 104 can include a first groove 512 along one side thereof that holds a first panel 108*a*. Moreover, the external mount 104 can include a second groove 514 along an opposing side thereof that holds a second panel 108*b*. The first groove 512 and second groove 514 allow an assembler to insert an edge of the decorative panel 108*a* and 108*b*, respectfully, in order to secure the decorative panel to the external mount 104.

In one example implementation, the first groove 512 can have an inwardly angled configuration, and the second groove 514 can have an opposing outwardly angled configuration. As a result, the external mount 104 can retain the decorative panels 108 in either a concave or convex configuration. As used herein, the term "inwardly angled" shall mean that the groove is angled toward the wall, ceiling, or other support structure to which the mounting system is fixed. The term "outwardly angled" shall mean that the groove is angled away from the wall, ceiling, or other support structure to which the mounting system is fixed.

The external mount 104 illustrated in FIG. 5D includes a receiving portion 504 that allows an assembler to couple the external mount 104 to the internal mount 102 in a first orientation, or rotate the external mount 104 one hundred and eighty degrees and couple the external mount 104 to the internal mount 102 in a second configuration. As a result, the assembler can control the location of the first groove 512 and the second groove 514, which in turn controls the wave-like pattern that an assembler can create with the decorative panels 108.

For example, in one instance, an assembler may desire that the first groove 512 having an inwardly angled configuration be facing a first direction and the second groove 514 having an outwardly angled configuration be facing a second opposing direction. In another instance, however, the assembler may desire that the first groove 512 face the second direction and the second groove 514 face the first direction. In this way, the symmetrical nature of the external mount 104 allows the assembler to control the position and direction of the first and second grooves 512 and 514 and the corresponding configuration of decorative panels 108 to be installed into the grooves.

In particular, due to the inwardly angled groove, an assembler can use the first groove 512 to mount a concave first decorative panel 108*a*, as illustrated in FIG. 5D. Moreover, due to the outwardly angled groove, an assembler can use the second groove 514 to mount a convex second decorative panel 108*b*. The assembler can alternate the orientation of the external mount 104 going from one internal mount 102 to the next to form a wave-like formation from the alternating convex and concave decorative panels (see FIG. 1A and FIG. 2).

Moreover, the assembler can further alternate the orientation of the external mount 104 going across a single internal mount 102 such that decorative panels 108 that are adjacent to each other can also alternate between convex and concave (see FIG. 3).

Figure 6A:
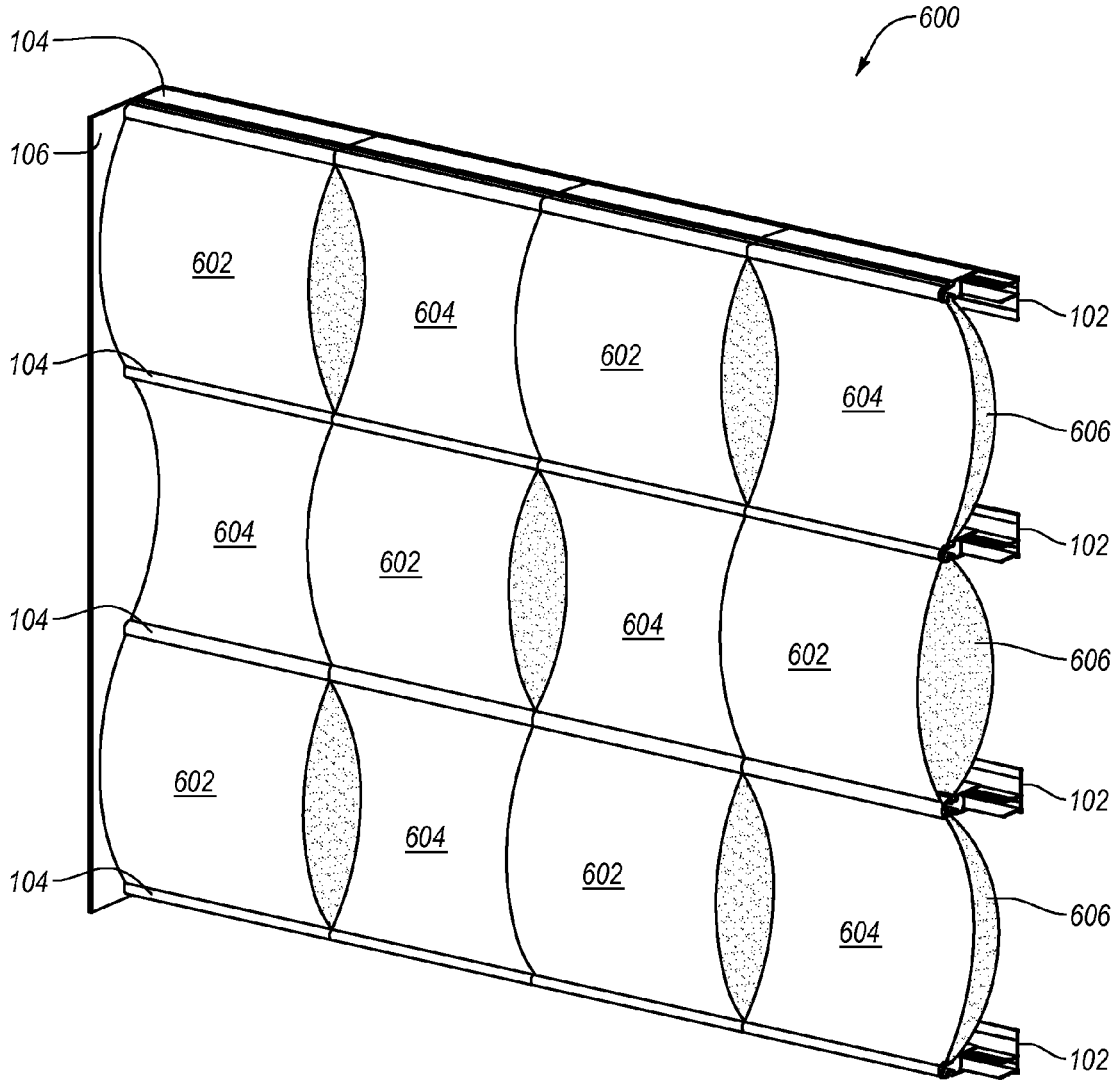
FIG. 6A illustrates a perspective view of an additional example mounting configuration with a shadow effect.

In addition to mounting a single decorative panel between two external mounts 104, an assembler can use the external mounts 104 to mount additional decorative panels. For example, FIG. 6A illustrates one example implementation of a decorative feature 600 in which an assembler can mount a "shadow" decorative panel 606 behind a series of convex decorative panels 602 and concave decorative panels 604. As FIG. 6A illustrates, the shadow decorative panel 606 provides an additional aesthetic to the decorative feature 606 that allows a particular color shade to show through the gaps between the convex decorative panels 602 and the concave decorative panels 604.

In one implementation, and as FIG. 6A illustrates, the shadow decorative panel 606 can be darker in color compared to the convex decorative panel 602 and the convex decorative panel 604 in order to provide a shadow effect. In alternative implementations, however, the shadow decorative panel 606 does not necessary need to be darker in color. A designer may choose to have the shadow decorative panel 606 to have virtually any color, shading, or pattern that provides the aesthetic that the designer desires.

Figure 6B:
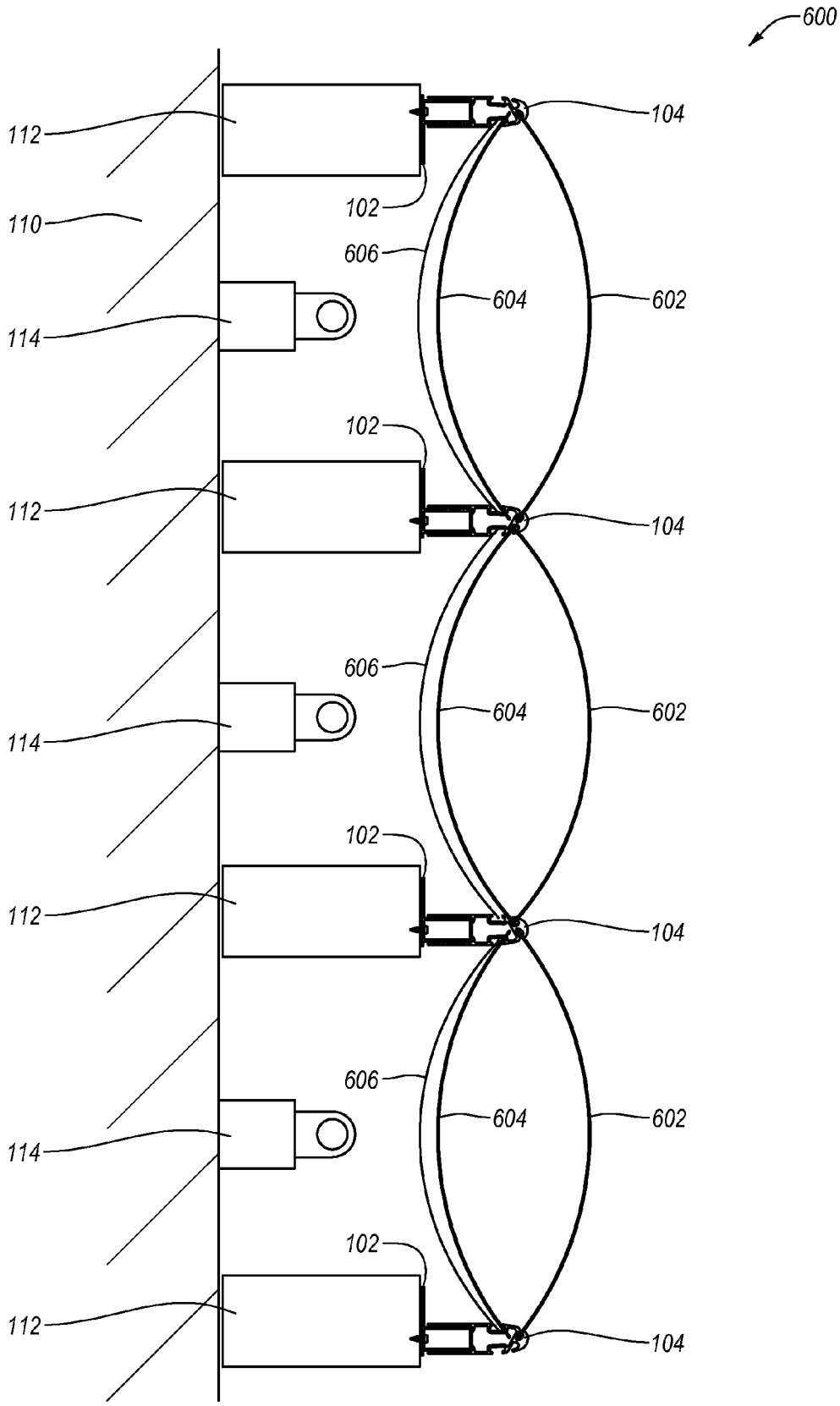
FIG. 6B illustrates a side view of the mounting configuration with a shadow effect illustrated in FIGS. 6A.

Notwithstanding the decorative characteristics of the shadow decorative panel 606, FIG. 6B illustrates an example side view of the decorative feature 600. As FIG. 6B shows, an assembler can mount the convex decorative panels 602 and concave decorative panels 604 as discussed above. In addition, and assembler can mount the shadow decorative panel 606 to the external panel 104 in such a way that the shadow decorative panel is behind the convex decorative panels 602 and the concave decorative panels 604 (i.e., between the support structure 110 and the convex and concave decorative panels 602 and 604).

As with previous implementations, the decorative feature 600 can include battens 112 that and assembler can mount to the support structure 110. An assembler can then mount the internal mounts 102 to the battens 112 to provide a desired offset from the support structure 110. Moreover, the decorative feature 600 can include light sources 114 to illuminate the decorative feature 660 to provide a desired illuminated aesthetic as discussed with previous implementations.

Figure 6C:
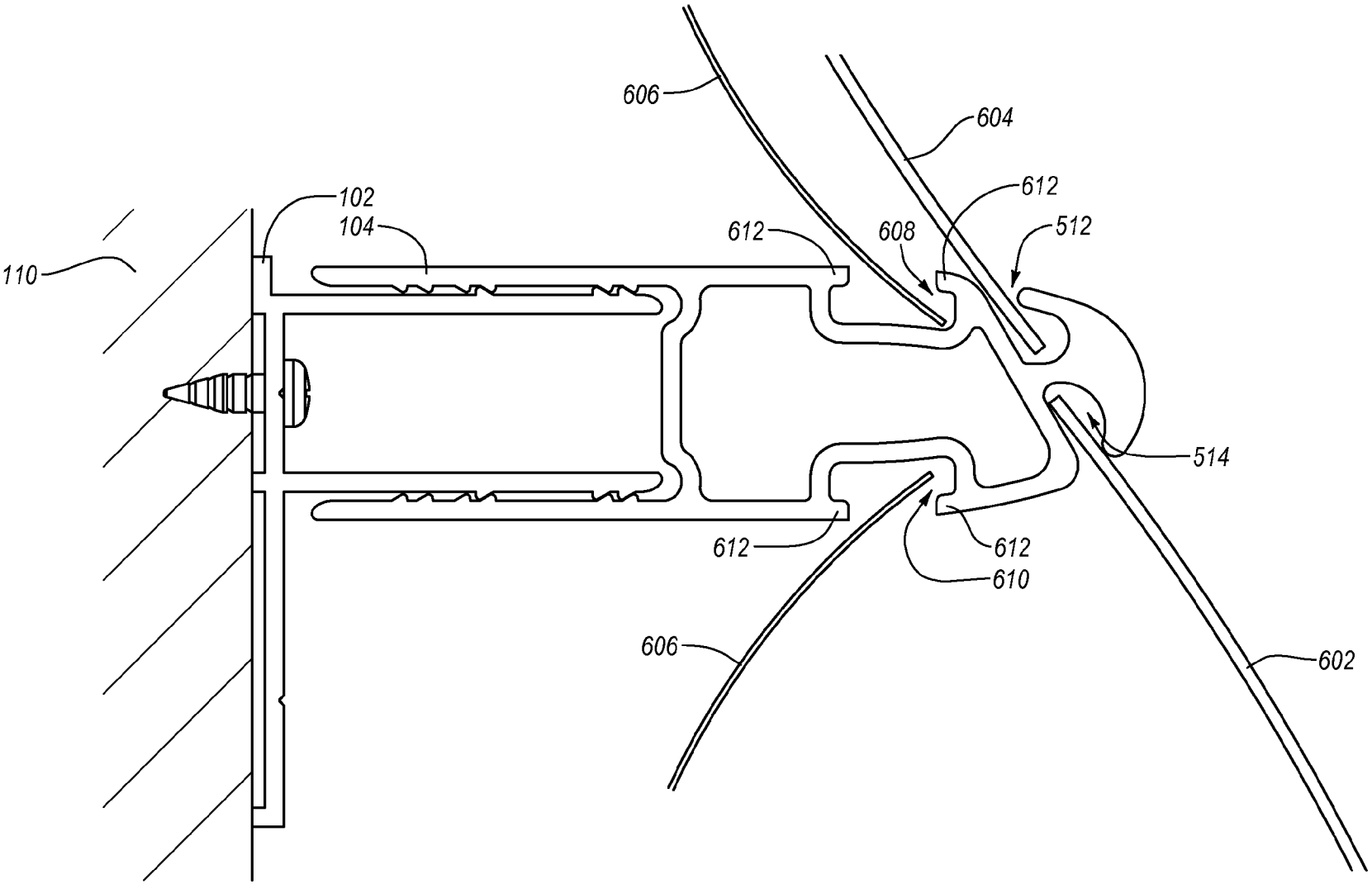
FIG. 6C and illustrates a cross-sectional view of an example mounting system with the shadow effect configuration illustrated in FIGS. 6A and 6B.

Regardless of the various features used in connection with the decorative feature 600, FIG. 6C further illustrates how an assembler can mount the shadow decorative panels 606 using the external mount 104. For example, FIG. 6C illustrates that the external mount can include an upper groove 608 and a lower groove 610. Both the upper groove 608 and the lower groove 610 include groove lips 612.

An assembler can insert the bottom edge of the shadow decorative panel 606 into the upper groove 608 and then bend or deflect the shadow decorative panel 606 to insert the upper edge of the shadow decorative panel 606 into the lower groove 610 of an adjacent external mount 104. Similarly, an assembler can insert the upper edge of the shadow decorative panel 606 into the lower groove 610 and then bend or deflect the shadow decorative panel 606 to insert the lower edge of the shadow decorative panel into the upper groove 608 of an adjacent external mount 104.

The groove lips 612 allow the external mount 104 to securely hold the edges of the shadow decorative panel 606. Moreover, a manufacturer can vary the dimensions of the groove lips 612 such that the angle at which the shadow decorative panel is deflected after installation can vary. In this way, the final installed shape of the shadow decorative panel 606 can vary from one implementation to the next. Another way to vary the final installed shape of the shadow decorative panel is to adjust the distance between the external mounts 104. The greater the distance between the external mounts, the more flat the installed shape will be for a given size of shadow decorative panel 606.

After the assembler has installed the shadow decorative panel(s) 606, the installer can then install the convex decorative panel(s) 602 and the concave decorative panel(s) 604 using the first groove 512 and second groove 514 as discussed previously.

In addition to the four grooves illustrated in FIG. 6C (i.e., the first groove 512, the second groove 514, the upper groove 608, and the lower groove 610) the external mount 104 can include additional grooves such than an assembler can mount additional decorative panels to create a broader range of decorative characteristics. Moreover, the location of the four grooves can vary from one implementation to the next causing the distance between the first and second grooves 512 and 514 to be spaced further apart from the upper and lower grooves 608 and 610. Therefore, a designer could specify the distance between the shadow decorative panel 606 and the convex and concave decorative panels 602 and 604, respectfully.

Figure 7:
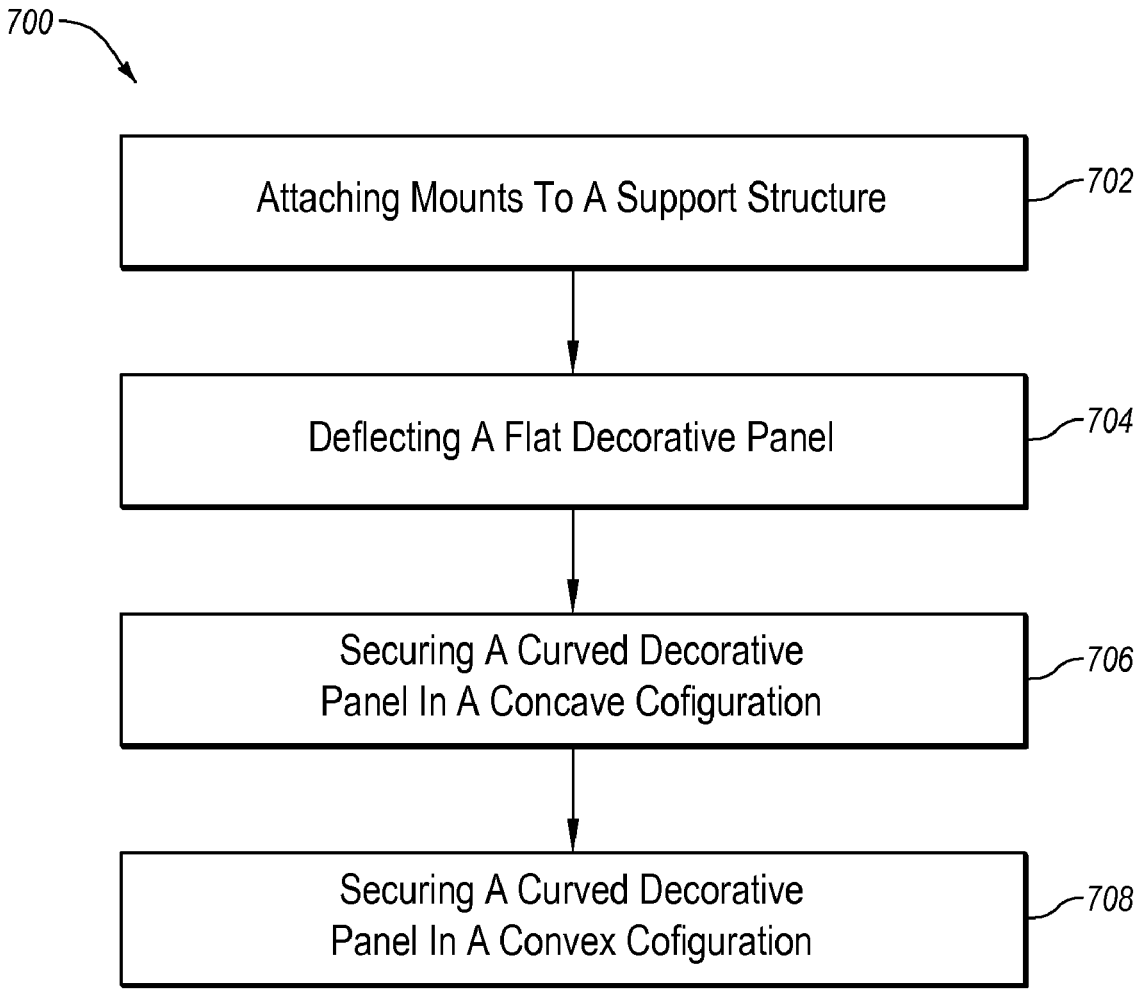
FIG. 7 illustrates and example method of installing a decorative feature with a wave-like appearance.

Accordingly, FIGS. 1A through 6C and the corresponding text provide a number of different components and systems that can efficiently allow an assembler to install a decorative feature having a wave-like appearance. In addition to the foregoing, implementations of the present invention can also be described in terms of flowcharts comprising one or more acts in a method for accomplishing a particular result. For example, FIG. 7 illustrates a method of installing a decorative feature having a wave-like configuration. The acts of FIG. 7 are discussed more fully below with respect to the components discussed with reference to FIGS. 1A through 6C.

For example FIG. 7 shows that the method of installing a decorative feature having a wave-like configuration comprises an act 702 of attaching mounts to a support structure. Act 702 includes attaching a plurality of mounts to a support structure in a parallel row configuration. For example, FIGS. 1A and 1B illustrate internal mounts 102 and external mounts 104 attached to support structure 110 in a parallel row configuration.

Also, FIG. 7 shows that the method of installing a decorative feature having a wave-like configuration comprises an act 704 of deflecting a flat decorative panel. Act 704 includes deflecting one or more flat decorative panels to form a curved decorative panel. For example, FIGS. 4A through 4C illustrate example implementations of flat decorative panels 402, 406, and 410, and FIG. 4D illustrates the decorative panels in a curved configuration.

In addition, FIG. 7 shows that the method of installing a decorative feature having a wave-like configuration comprises an act 706 of securing a curved decorative panel in a concave configuration. Act 706 includes securing one or more curved decorative panels between the mounts in a concave configuration. For example, FIG. 6A illustrates decorative panels 604 secured in a concave configuration.

Furthermore, FIG. 7 shows that the method of installing a decorative feature having a wave-like configuration comprises an act 708 of securing a curved decorative panel in a convex configuration. Act 708 includes securing one or more curved decorative panels between the mounts in a convex configuration. For example, FIG. 6A illustrates decorative panels 602 secured in a convex configuration.

Accordingly, the diagrams and text corresponding to FIG. 1A through FIG. 6C illustrate or otherwise describe a number of methods, devices, systems, configurations, and components that an operator can use to install a decorative feature having a wave-like configuration. Such methods, devices, systems, configurations, and components can provide an efficient, reliable, and repeatable installation process when compared to conventional devices and methods. Thus, designer and assemblers can use implementations of the present invention to efficiently, reliably and productively install a decorative feature having a wave-like configuration.

The present invention can be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

We claim:

1. A system for installing a decorative feature having a wave-like appearance, the system comprising:

a first internal mount and second internal mount coupled to a support structure having a distance between the first internal mount and the second internal mount;

a first external mount connected to the first internal mount and a second external mount connected to the second internal mount, wherein the first external mount and the second external mount both include at least one groove; and at least one decorative panel having a first edge that interfaces with the groove in the first external mount and a second edge that interfaces with the groove in the second external mount, wherein:

the decorative panel is secured between the first external mount and the second external mount with a convex or concave deflection to create the wave-like appearance;

the at least one groove comprises a first groove and a second groove located on opposite sides of the external mount; and the first groove includes an angle that biases the decorative panel to have a convex deflection and the second groove includes an angle that biases the decorative panel to have a concave deflection.

2. The system of claim 1, wherein the at least one groove further comprises:

a upper groove and a lower groove located on opposite sides of the external mount, wherein a shadow decorative panel can be secured between the lower groove of the first external mount and the upper groove of the second external mount.

3. The system of claim 1, wherein the internal mount comprises a U-shaped extension having a plurality of raised protrusions.

4. The system of claim 3, wherein the external mount comprises a receiving portion having a plurality of raised protrusions that is configured to receive the U-shaped extension of the internal mount, wherein the plurality of raised protrusions on the U-shaped extension interface with the plurality of raised protrusions on the receiving portion such that the U-shaped extension is securely held within the receiving portion.

5. The system of claim 1, further comprising one or more battens that mount between the internal mount and the support structure to increase the standoff distance between the at least one decorative panel and the support structure.

6. The system of claim 1, further comprising one or more light sources coupled to the support structure such that light is directed towards the at least one decorative panel.

7. The system of claim 1, wherein the internal mount and external mount comprise elongated aluminum extrusions.

8. An decorative panel mounting assembly having decorative panels that form a wave-like aesthetic, comprising:

a plurality of external mounts coupled to a support surface in parallel rows;

a plurality of decorative panels secured between the plurality of external mounts to form rows of decorative panels, wherein:

the rows of decorative panels alternate between the decorative panels having a convex configuration and having a concave configuration to form a wave-like appearance; and the decorative panels having a convex configuration overlap at least a ortion of the decorative panels having a concave configuration.

9. The assembly in claim 8, wherein a single row of decorative panels comprises decorative panels having a convex configuration and decorative panels having a concave configuration.

10. The assembly in claim 8, wherein the decorative panels with a concave configuration comprise at least one end with a smaller width, the decorative panels having a convex configuration overlapping the end with a smaller width.

11. The assembly in claim 8, wherein the rows of decorative panels are horizontal.

12. The assembly in claim 8, wherein the rows of decorative panels are vertical.

13. The assembly in claim 8, wherein at least one of the external mounts comprises:

a unitary piece having an angled grove on one side that biases a decorative panel to have a convex deflection; and on an opposing side a second angled groove that biases a decorative panel to have a concave deflection.

14. A method of installing a decorative feature with a wave-like appearance to a support structure, the method comprising:

attaching a plurality of mounts to a support structure in a parallel row configuration;

deflecting one or more flat decorative panels to form a curved decorative panel;

securing one or more curved decorative panels between the mounts in a concave configuration;

securing one or more curved decorative panels between the mounts in a convex configuration; and installing one or more shadow panels between the one or more flexible decorative panels and the support structure.

15. The method of claim 14, wherein the attaching mounts to a support structure comprises attaching an internal mount to the support structure and connecting an external mount to the internal mount.

16. The method of claim 14, wherein the one or more flexible decorative panels alternate between a convex and concave configuration along a length of a single mount.

17. The method of claim 14, wherein the one or more flexible decorative panels alternate between a convex and concave configuration from one row to the next in the parallel row configuration.

18. A system for installing a decorative feature having a wave-like appearance, the system comprising:

first and second mounts coupled to a support structure, wherein a distance separates the first mount from the second mount;

a groove on an upper side of each of the first and second mounts, and a groove in an opposing side of each of the first and second mounts a first decorative panel mounted between the first and second mount in one of a convex or concave configuration; and a second decorative panel mounted within the first mount, the second decorative panel being mounted above the first decorative panel in the opposite convex or concave configuration of the first panel;

wherein the first and second mounts each comprise a unitary piece having a groove that biases a decorative panel toward a convex or concave configuration on one side, and, on an opposing side, another groove that bases a decorative panel toward the opposite of a convex or concave configuration.

19. The system as recited in claim 18, further comprising first and second internal mounts.

20. The system as recited in claim 18, wherein the first and second mounts into which the first and second decorative panels are mounted comprise first and second external mounts configured to be mounted within the first or second internal mounts.

* * * * *